United States Patent [19]

Polleck et al.

[11] Patent Number: 4,491,516

[45] Date of Patent: Jan. 1, 1985

[54] HYDROLYSIS OF CARBONYL SULFIDE OVER ALUMINA

[75] Inventors: Richard E. Polleck, Wilmington, Del.; Kenneth A. Scott, Swarthmore, Pa.; Robert E. Ledley, Hockessin, Del.

[73] Assignee: Sun Refining and Marketing Company, Philadelphia, Pa.

[21] Appl. No.: 554,480

[22] Filed: Nov. 22, 1983

[51] Int. Cl.[3] ..... C10G 29/16

[52] U.S. Cl. ..... 208/248; 208/208 R; 585/852

[58] Field of Search ..... 208/248, 208 R; 585/852, 855

[56] References Cited

U.S. PATENT DOCUMENTS 2,772,208 11/1955 Ferm ..... 585/952
3,000,988 9/1961 Karchmer et al. ..... 423/242
3,058,800 10/1962 Frevel ..... 423/437
3,265,757 8/1966 Frevel et al. ..... 585/852

FOREIGN PATENT DOCUMENTS 2108146 5/1983 United Kingdom ..... 585/952

*Primary Examiner*—W. J. Shine
*Assistant Examiner*—Anthony McFarlane
*Attorney, Agent, or Firm*—J. Edward Hess; Donald R. Johnson

[57] ABSTRACT

The reaction rate for the hydrolysis of carbonyl sulfide in liquid petroleum hydrocarbons over alumina, such as propylene, is greatly increased by maintaining water in the hydrocarbons in an amount of one mole of water per mole of carbonyl sulfide to an upper limit of about ten moles of water per mole of carbonyl sulfide or about 30% of saturation of the hydrocarbons, whichever upper limit provides the lesser amount of water.

11 Claims, 1 Drawing Figure

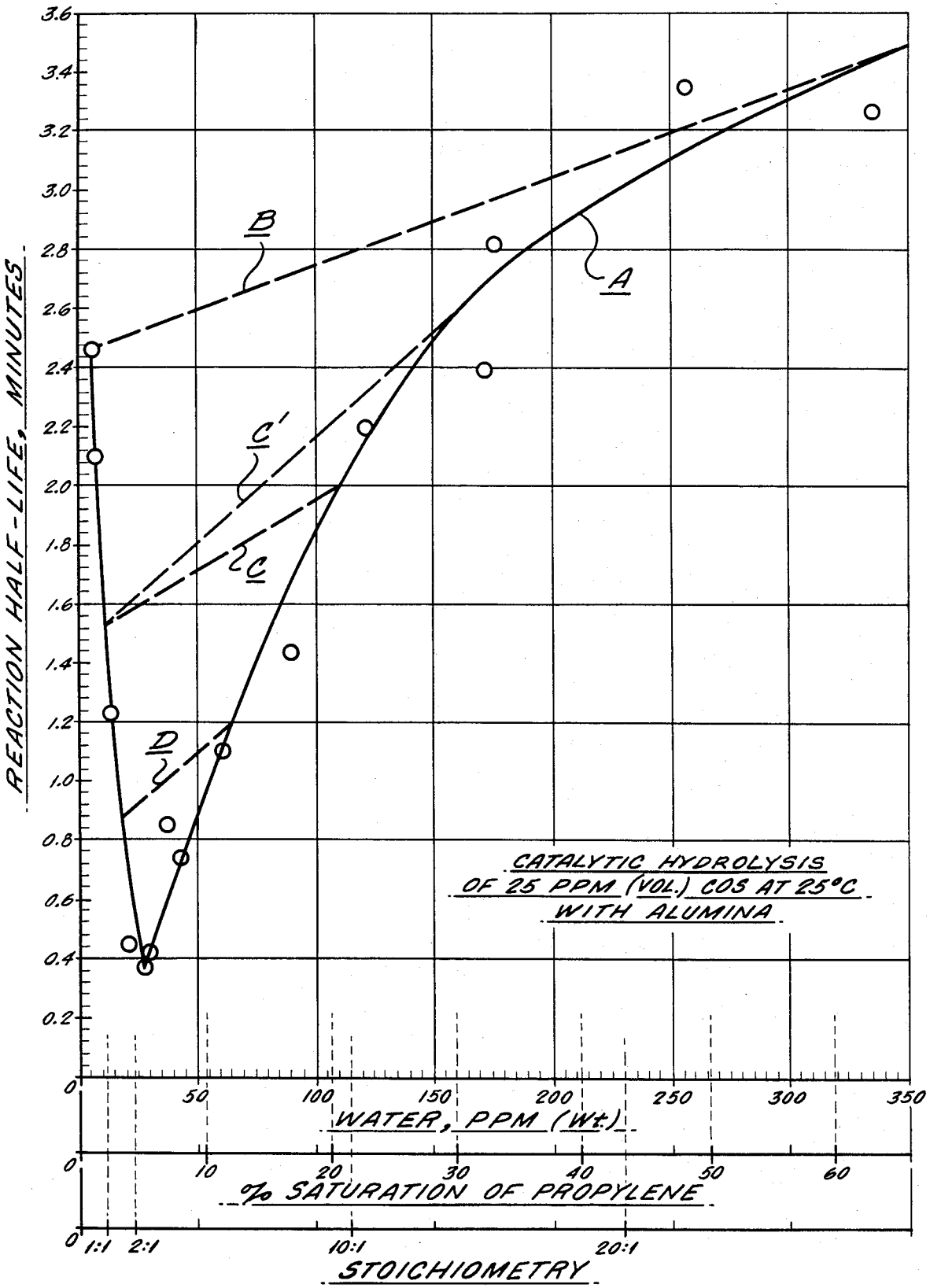
REACTION HALF-LIFE, MINUTES
3.6
3.4
3.2
3.0
2.8
2.6
2.4
2.2
2.0
1.8
1.6
1.4
1.2
1.0
0.8
0.6
0.4
0.2
0
B
A
C'
C
D
CATALYTIC HYDROLYSIS
OF 25 PPM (VOL.) COS AT 25°C
WITH ALUMINA
50
100
150
200
250
300
350
WATER, PPM (Wt.)
10
20
30
40
50
60
% SATURATION OF PROPYLENE
1:1
2:1
10:1
20:1
STOICHIOMETRY

HYDROLYSIS OF CARBONYL SULFIDE OVER ALUMINA

BACKGROUND OF THE INVENTION

This invention relates to the removal of carbonyl sulfide (COS) from liquid petroleum hydrocarbons by catalytic hydrolysis over alumina.

Carbonyl sulfide is undesirable in petroleum hydrocarbons because it is a sulfur source, and therefore a potential atmospheric pollutant and contaminant of industrial processes. A significant instance of the latter is the poisoning of polymerization catalysts by the COS commonly present in petroleum-derived polymerizable olefins such as propylene. With the advent of high activity catalysts, however, the COS must be reduced to levels well below those previously required. Thus, the COS level may be required to be reduced to below 1 ppm (parts per million by weight) and sometimes to levels below 100 ppb (parts per billion by weight) e.g., to 50 ppb or less.

The ability to attain the lower levels of COS must also be coupled with high reaction rate and capability of practice on an economic scale. For reasons discussed subsequently, high reaction rates and the smaller reactor sizes which can be used as a consequence of higher reaction rates, are of particular importance in the removal of COS from liquid petroleum hydrocarbons by catalytic hydrolysis over alumina. From the standpoints of process efficiency and economy, treater sizes (gross alumina bed volumes) of 800 cu. ft. or less, preferably 600 cu. ft. or less, are desirable.

U.S. Pat. No. 3,265,757 to Frevel and Kressley describes the hydrolysis of COS in liquid aliphatic hydrocarbons by treatment at 20° C. to 50° C. with an alumina catalyst wherein an amount of water equal to 0.3A ppm to 12T ppm (where A is the COS concentration in ppm (wt.) and T is degrees centigrade temperature) is maintained in the hydrocarbons during the treatment. The only treatment conditions specifically mentioned are treatment at 32° C. of liquid propylene containing 49 ppm COS at a propylene flow rate of 60 gallons per minute through an alumina bed, while feeding ion-free water to the propylene feed stream at 0.0104 gallons per minute to thereby maintain 290 ppm of water in the propylene. (The 290 ppm of water provides 19.7 times the stoichiometric amount of water required for reaction with COS.) The COS was reduced to less than 1 ppm (detection limits of the analysis). A predecessor Frevel and Kressley patent, U.S. Pat. No. 3,058,800, describes catalytic hydrolysis of COS in a gaseous stream over alumina at 35° C. to 250° C. wherein from 1 to about 2 moles of water per mole of COS preferably is maintained in the gas stream. Neither patent provides any specific guidance to process results, and reaction rates specifically, when treating liquid petroleum hydrocarbons at less than the 290 ppm of water recited in Example 1 of U.S. Pat. No. 3,265,757.

British patent publication No. 2,108,146 published May 11, 1983 citing U.S. application Ser. No. 298,702 filed Sept. 1, 1981 for priority, describes the catalytic hydrolysis over a platinum sulfide/alumina catalyst of COS in gaseous or liquid propylene, containing at least double the stoichiometric amount of water required for reaction with the COS. As compared to the use of alumina alone as the catalyst, the process is burdened by the cost of the platinum sulfide catalyst and the necessity of regenerating the platinum sulfide.

Alumina is disclosed as a dehydrating agent for gases containing COS in U.S. Pat. No. 3,000,988 to Karchmer and Walker. U.S. Pat. No. 2,772,208 to Ferm incidentally discloses that alumina dehydrates liquefied petroleum gas while also decomposing COS in the liquefied gas to form corrosive products. Neither patent discloses or suggests that water content in the gas might be critical for effective catalytic decomposition of the COS over alumina alone.

SUMMARY OF THE INVENTION

It has been found that control of water content in liquid petroleum hydrocarbons (as hereinafter defined) is unexpectedly critical for hydrolyzing COS in the hydrocarbons at hydrolysis rates effective for COS half-lives (minutes to reduce COS to 50% of the initial amount in the feed) of two minutes or less. (Half-life varies inversely with reaction rate.) This is achieved by passing liquid petroleum hydrocarbons containing COS over alumina while maintaining water in the hydrocarbons in an amount of from one mole of water per mole of COS to an upper limit of ten moles of water per mole of COS or about 30% of saturation of the hydrocarbons, whichever upper limit provides the lesser amount of water. (By "saturation" is meant the maximum amount of water soluble in the hydrocarbons at a given reaction temperature). A practical and economic consequence is that smaller alumina catalytic treater beds may be utilized, thus avoiding the capital investment and more difficult hydrolysis control problems of larger treaters, such as higher water content (inventory) and resulting longer times to attain equilibrium conditions. Smaller reactors respond more quickly than larger reactors to changes in the water content of the feed. Therefore, in the event of an upset in the water content in the reactor for any reason, the condition can be corrected more rapidly in the smaller reactor, thus reducing the amount of off-specification product resulting from the upset.

More preferred amounts of water are from about 1.5 moles of water per mole of COS to an upper limit of about 6 moles of water per mole of COS or about 20% of saturation of the hydrocarbons, whichever upper limit provides the lesser amount of water. Under the preferred conditions reaction rate is even further enhenced, the COS half-life being about 1.5 minutes or less, e.g., 0.45 minute at 75° F. (24° C.), and the treater capacity requirement is reduced.

DETAILED DESCRIPTION

In this specification, "petroleum hydrocarbons" means well-head petroleum, natural gases, synthetic gaseous hydrocarbons, and any derivative hydrocarbons from petroleum refinery processes including distillation, cracking and reforming. Of the petroleum hydrocarbons, this invention concerns liquid hydrocarbons, whether normally liquid materials or liquefied normally gaseous materials. In either case, the hydrocarbons may be single materials, such as a propylene stream, or may be mixtures of two or more different materials, such as a mixed propylene-propane stream, or mixtures of hydrocarbons of different carbon content. Typically, the hydrocarbons are aliphatic (cyclic or acyclic) compounds containing 1 to 5 carbon atoms, singly or in admixture, but higher carbon content hydrocarbons containing COS can be treated in accordance with the invention, if desired.

If the petroleum hydrocarbons containing the COS are gaseous, the hydrocarbons are liquefied by maintaining appropriate pressure during the catalytic treatment. For propylene a suitable pressure is from about 190 psig to about 1,000 psig, preferably from about 250 psig to about 400 psig. Reaction temperature may range from about 10° to 70° C., and preferably from 20° C. to about 65° C. more preferably, about 25° C. to about 50° C. Temperature elevation will increase the reaction rate, a 10° C. rise in temperature being effective to about double the reaction rate. Higher temperature will also raise the solubility of water in the hydrocarbons, thereby reducing the percent of saturation of a given water content in the hydrocarbons. The water added to the hydrocarbons preferably is deionized water.

Other conditions of the catalytic hydrolysis are well known. Thus, the alumina is any of the catalytic alkaline aluminas known to be effective for COS hydrolysis, such as those described in U.S. Pat. No. 3,265,757 and the activated aluminas available commercially from Reynolds Metals Company or Aluminum Company of America identified as Activated Alumina RA-1 and Activated Alumina F-1, respectively. Those skilled in the art can readily calculate the cross-section of alumina bed necessary to achieve economically low linear velocities, and the bed volume required for the residence time desired. For example, the following set of conditions for reducing COS from 30 ppm (vol.) to 20 ppb (vol.) in liquid propylene flowing at up to 290 barrels per hour through an alumina bed, would require a bed volume of 530 cu. ft.:

Water input: 3-40 ppm (wt.).
$H_2S$ output: 0.05 ppm (wt.) max.
Operating temp.: 75° F.-115° F.
COS half-life: 0.45 minute.

Any separation processes known in the art for separating the hydrolysis products (hydrogen sulfide and carbon dioxide) of the alumina treatment may be employed. Typically, these are alkaline treatments such as adsorption with sodium hydroxide or soda-lime, as described in U.S. Pat. No. 3,315,003 to Khelghatian.

The attached drawing is a plot of a series of hydrolysis reactions which were run in accordance with the conditions and procedure described in Example 1 below to determine reaction rates in terms of COS half-lives relative to the amount of water in the hydrocarbons (average of amounts of equilibrium at the inlet and outlet of an activated catalytic treater) expressed as percent of saturation and ppm (wt.) in the propylene. The stoichiometry of the COS/water reaction for the conditions of Example 1 as well as amount of water and % saturation is indicated on the abscissa (a 1:1 mole ratio of water to COS occurs at 11.8 ppm (wt.) of water).

Curve A indicates an initial sharp increase in the hydrolysis reaction rate (decrease in half-life) from the initial measurement at about 1% of saturation (6 ppm $H_2O$ or <1:1 water to COS mole ratio) to a maximum and then a decrease to the final measurement at 61.6% of saturation (336 ppm water, >20:1 water to COS mole ratio). Tie-line B illustrates the result if a linear effect of water content of half-life existed between water contents of about 5 ppm and about 300 ppm by weight based on propylene, as contrasted with the actual relationship shown by curve A. Since theoretically complete hydrolysis requires at least a 1:1 water to COS mole ratio and economic considerations (treater bed size, water content in the treater and time to equilibrium) strongly favor a half-life of no more than about 2 minutes, it can be seen that the water in the propylene should be maintained at a water:COS mole ratio of from 1:1 to about 10:1, or saturation of from about 2% to about 20%, as represented by tie line C. The more preferred conditions (for the conditions of the figure and for reaction rates expressed as half-lives at 25° C. of less than 0.9 to about 1.2 minutes) are indicated by tie line D: a water to COS mole ratio of about 1.5:1 to about 6:1 or saturation of from about 3% to about 12%.

Tie-line C' shows the result if the upper limit of water content were 30% of saturation (tie-line C') rather than mole percent of about 10:1 (tie-line C), in treatment of a feed containing 25 ppm (vol) of COS. In a feed containing a greater amount of COS, if 30% of saturation is a lower amount of water than a mole ratio of 10:1, the upper limit for the purposes of this invention, is 30% of saturation. Saturation refers to the solubility of water in propylene at a given reaction temperature, which may be determined by a person skilled in the art by reference to published information, such as API Technical Data Book, Section 9, page 9, FIG. 9A1.1 (July 1968).

While not fully understood, it is believed that the surprising criticality in this invention of water content for more effective hydrolysis of COS in liquid petroleum hydrocarbons is related to competition between the water and the COS for adsorption or absorption sites on the alumina as expressed in the following reactions describing possible steps in the hydrolysis:

| | |
|---|---|
| Adsorption: | (1) $COS + Al_2O_3 \rightarrow Al_2O_3.COS^*$ (adsorbed form) |
| | (2) $HOH + Al_2O_3 \rightarrow Al_2O_3.HOH^*$ (adsorbed form) |
| Reaction: | (3) $COS^* + HOH^* \rightarrow CO_2^* + HSH^*$ (adsorbed form) |
| Desorption: | (4) $Al_2O_3.CO_2^* \rightarrow Al_2O_3 + CO_2$ |
| | (5) $Al_2O_3.HSH^* \rightarrow Al_2O_3 + HSH$ |

If higher concentrations of water are present (e.g., over 30% of saturation of the hydrocarbons) it appears that the excess water inhibits adsorption/absorption of the COS on the alumina and reaction (2) will dominate over reaction (1) to the detriment of the hydrolysis reaction (3). Hence, water content must be controlled within a limited range as described herein.

The following examples illustrate application of the invention on pilot plant and plant scales.

EXAMPLE 1

In pilot plant studies, liquid propylene from an LPG cylinder was pumped through a reaction tube (0.76 cm inside diameter×35 cm length) containing 15.7 g of crushed and sieved (16–18 mesh) activated alumina (REYNOLDS RA-1). Sampling valves positioned before and after the reactor allowed sampling of the propylene feed and product. Moisture probes (M-Series, Panametrics, Inc.) installed before and after the reactor allowed measurement of temperature and moisture content of the propylene entering and leaving the reactor.

By flooding and drying the packed tube, a net void space in the alumina bed of 6.14 $cm^3$ was determined. Accordingly, with a typical metering rate of 300 ml/hr. (5.0 $cm^3$/min), a contact time with the alumina of 1.23 minutes was obtained. In some cases the metering rates were reduced to as low as 200 ml/hr (3.33 $cm^3$/min) to increase contact time. Reactor temperature was held in the 24.4° C. to 25.9° C. range.

Carbonyl sulfide (COS) was added periodically to a 75 ml. high pressure sample bomb, connected in parallel with the main tubing, to compensate for COS removed by reaction and to maintain a nominal 30 ppm by volume concentration of COS in the propylene feed. Another sample bomb, packed with soda-lime, was used to prevent the accumulation of excessive amounts of hydrogen sulfide from the hydrolysis reaction.

Water was added periodically through an isolated port to change the water concentration in the propylene to predetermined levels. The propylene was circulated at high rate through the system for a minimum of twelve hours to equilibrate the water on the alumina with the water in solution in the propylene. Two or more runs were made at each water level until results were consistent. In all cases, the water content of the propylene is assumed to be in equilibrium with the water in or on the alumina, i.e., they experience equal degrees (percent) of saturation. The average of operating and analytical results for each water level are summarized in Table I below, where the water in the propylene is the average of amounts measured at the propylene inlet and outlet at equilibrium. It will be seen from the data, as shown by curve A in the drawing, that substantial improvement in reaction rate as well as good COS removal were obtained at water/COS mole ratios of about 10/1 or less.

TABLE I

| Run Set No. | [1]Water in $PPM_w$ | Propylene % Sat. | Mole Ratio: $H_2O/COS$ | Contact Time Minutes | Carbonyl Sulfide Feed $PPM_v$ | Carbonyl Sulfide Product $PPM_v$ | COS Removed - % | Reaction Half-Life Minutes |
|---|---|---|---|---|---|---|---|---|
| 1 | 28 | 5.1 | 2.14/1 | 1.23 | 30.6 | 2.96 | 90.3 | 0.37 |
| 2 | 22 | 3.9 | 2.82/1 | 1.23 | 18.2 | 2.74 | 85.0 | 0.45 |
| 3 | 44 | 8.2 | 3.47/1 | 1.23 | 29.6 | 8.8 | 70.1 | 0.71 |
| 4 | 38 | 7.2 | 3.24/1 | 1.23 | 27.4 | 9.9 | 63.7 | 0.85 |
| 5 | 62 | 11.5 | 5.61/1 | 1.23 | 25.8 | 11.9 | 54.1 | 1.10 |
| 6 | 90 | 16.6 | 8.60/1 | 1.23 | 24.4 | 13.5 | 44.7 | 1.44 |
| 7 | 122 | 22.6 | 11.34/1 | 1.34 | 25.0 | 16.3 | 34.7 | 2.20 |
| 8 | 172 | 31.5 | 17.15/1 | 1.84 | 23.4 | 13.7 | 41.5 | 2.39 |
| 9 | 176 | 32.5 | 15.98/1 | 1.58 | 25.7 | 17.4 | 32.3 | 2.82 |
| 10 | 257 | 49.0 | 22.29/1 | 1.47 | 26.9 | 19.8 | 26.4 | 3.35 |
| 11 | 336 | 61.6 | 28.0/1 | 1.47 | 28.0 | 20.6 | 26.7 | 3.27 |
| 12 | 30 | 5.5 | 2.73/1 | 1.23 | 25.6 | 3.32 | 87.0 | 0.42 |
| 13 | 13 | 2.5 | 0.82/1 | 1.23 | 37.0 | 18.6 | 49.9 | 1.23 |
| 14 | 5.8 | 1.1 | 0.45/1 | 1.23 | 30.3 | 21.4 | 29.2 | 2.46 |
| 15 | 6.6 | 1.2 | 0.45/1 | 1.23 | 34.1 | 22.7 | 33.4 | 2.10 |

[1]Measured by Panametrics Moisture Instruments in treater outlet stream.

EXAMPLE 2

In a plant trial, propylene recovered overhead from a $C_3$ splitter (propylene-propane separator) was pumped through a 6 ft. diameter × 8.5 ft. high bed containing 10,000 lbs. of activated alumina (REYNOLDS RA-1). The temperature was established by available cooling in the splitter condenser and ranged from 78° to 96° F. (25°-36° C.). The net volume of the treating bed, exclusive of the space occupied by the alumina, was calculated as 96 ft.$^3$ Accordingly, with a throughput rate of 250 barrels per hour (BPH), a typical contact time of 4.1 minutes was realized.

As shown in the following Table II, where each entry represents the average of three operating days, the hydrolysis reaction varied critically with water content of the propylene. The initial, very low moisture level, was measured in the laboratory as part of an effort to understand poor hydrolysis performance. Subsequently, a moisture probe (M-Series, Panametrics, Inc.) was installed in the alumina treater effluent stream.

For very low water content in the propylene, e.g., 6 ppm by weight, the reaction rate was slow and only 85% of the carbonyl sulfide was hydrolyzed. In the optimal observed range of 22 to 66 ppm water, the hydrolysis was three to four times faster and product containing nil to 0.12 ppm COS was obtained. When the water content content of the propylene rose through 80 ppm the reaction slowed somewhat, and at 205 ppm of water the reaction was again very slow—removing only 79% of the input COS. These results thus closely approximate the results of the pilot plant studies of Example 1, as plotted in the attached figure.

TABLE II

| Run Set No. | Rate BPH | (1)Water in Propylene Outlet $PPM_w$ | Outlet % Sat. | Mole Ratio: $H_2O/COS$ | Carbonyl Sulfide Feed $PPM_v$ | Carbonyl Sulfide Product $PPM_v$ | COS Removed - % | Hydrolysis Half-Life Minutes |
|---|---|---|---|---|---|---|---|---|
| 1 | 235 | (2)6 | 0.8-1.5 | 0.66/1 | 21.3 | 3.2 | 85.0 | 1.60 |
| 2 | 265 | 22 | 3-5 | 2.3/1 | 22.3 | 0.11 | 99.49 | 0.50 |
| 3 | 235 | 31 | 4-6 | 2.9/1 | 25.0 | 0.12 | 99.52 | 0.56 |
| 4 | 265 | 37 | 4-6 | 4.2/1 | 20.4 | (3)Tr | 98.8 | (3)0.43 |
| 5 | 270 | 66 | 8-13 | 6.0/1 | 25.8 | NIL - 0.06 | 99.87 | 0.40 |
| 6 | 245 | 80 | 12-16 | 6.9/1 | 27.0 | 0.39 | 98.54 | 0.69 |
| 7 | 230 | 205 | 30-40 | 18.6/1 | 25.7 | 5.3 | 78.4 | 2.08 |

[1]Measured by Panametrics Moisture Instrument in treater outlet stream.
[2]Via laboratory anametrics Moisture Analyzer.
[3]Estimated at 0.040 ppm.
Half-life calculated on 0.040 ppm basis.

We claim:

1. A process for removing carbonyl sulfide from liquid petroleum hydrocarbons containing carbonyl sulfide, which comprises passing the hydrocarbons over alumina, under hydrolysis conditions, while maintaining water in the hydrocarbons in an amount of from one and a half moles of water per mole of carbonyl sulfide to an upper limit of about ten moles of water per mole of carbonyl sulfide or about 30% of saturation of the hydrocarbons, whichever upper limit provides the lesser amount of water.

2. The process of claim 1 wherein the hydrocarbons contain 1 to 5 carbon atoms.

3. The process of claim 1 wherein the hydrocarbons comprise olefins containing 1 to 5 carbon atoms.

4. The process of claim 3 wherein the olefins comprise propylene.

5. The process of claim 1 wherein the amount of water is from about 1.5 moles of water per mole of carbonyl sulfide to an upper limit of about 6 moles of water per mole of carbonyl sulfide or about 20% of saturation of the hydrocarbons, whichever upper limit provides the lesser amount of water.

6. The process of claim 5 wherein the hydrocarbons contain 1 to 5 carbon atoms.

7. The process of claim 5 wherein the hydrocarbons comprise olefins containing 1 to 5 carbon atoms.

8. The process of claim 7 wherein the olefins comprise propylene.

9. The process of claim 5 wherein the removal is conducted at a temperature of from about 10° C. to about 70° C.

10. The process of claim 5 wherein the hydrocarbons comprise propylene, and the removal is conducted at a temperature of from about 10° C. to about 70° C.

11. The process of claim 1 wherein the hydrocarbons comprise propylene, the removal is conducted at a temperature of from about 10° C. to about 70° C., and the amount of water in the propylene is from about 1.5 moles per mole of carbonyl sulfide to an upper limit of about 6 moles per mole of carbonyl sulfide or about 10% of saturation of the propylene, whichever upper limit provides the lesser amount of water.

* * * * *